US005464382A

United States Patent [19]

Wang

[11] Patent Number: 5,464,382

[45] Date of Patent: Nov. 7, 1995

[54] VARIABLE MASSAGE DRIVE UNIT FOR A CHAIR-TYPE MASSAGE APPARATUS

[76] Inventor: Shui-Mu Wang, No. 111, Chung-Shan S. Rd., Yung-Kany City, Tainan Hsien, Taiwan

[21] Appl. No.: 359,068

[22] Filed: Dec. 19, 1994

[51] Int. Cl.[6] ..... A61H 7/00

[52] U.S. Cl. ..... 601/99; 601/24; 601/108; 601/116

[58] Field of Search ..... 601/99, 100, 97, 601/98, 100–103, 107–111, 134, 90, 115, 116, 23, 24, 26; 606/242

[56] References Cited

U.S. PATENT DOCUMENTS

| | | | |
|---|---|---|---|
| 4,327,713 | 5/1982 | Okazaki et al. . | |
| 4,422,448 | 12/1983 | Sugai | 601/99 |
| 4,574,786 | 3/1986 | Hashimoto | 601/99 |
| 4,615,336 | 10/1986 | Fijimoto | 601/99 |
| 4,718,408 | 1/1988 | Barreiro . | |
| 5,052,376 | 10/1991 | Yamasaki . | |

*Primary Examiner*—Robert A. Hafer
*Assistant Examiner*—David J. Kenealy

[57] ABSTRACT

A variable massage drive unit includes a rotatable drive shaft disposed uprightly in a hollow casing and having two end portions that extend out of the hollow casing, upper and lower bearings for mounting rotatably the end portions of the drive shaft to the hollow casing, first and second drive gears disposed coaxially on the drive shaft, and first and second one-way clutches provided coaxially on the drive shaft between the drive shaft and a respective one of the drive gears. The drive gears are provided on a respective one of the end portions of the drive shaft between an intermediate portion of the drive shaft and an adjacent one of the upper and lower bearings. First and second thrust bearings are disposed coaxially and respectively on the drive shaft between the intermediate portion of the drive shaft and the first one-way clutch, and between the first one-way clutch and the upper bearing.

2 Claims, 4 Drawing Sheets

VARIABLE MASSAGE DRIVE UNIT FOR A CHAIR-TYPE MASSAGE APPARATUS

BACKGROUND OF THE INVENTION

1. Field of the Invention

The invention relates to a variable massage drive unit for a chair-type massage apparatus, more particularly to a variable massage drive unit having one-way clutches for driving selectively alternate gear sets of the massage drive unit.

2. Description of the Related Art

A known variable massage apparatus, which is mountable on the backrest of a chair, comprises a flat horizontal platform, a vertically extending guide unit mounted perpendicularly on the platform, and a massage drive unit mounted slidably on the guide unit. The massage drive unit includes a hollow casing, a rotatable drive shaft which is disposed uprightly in the hollow casing and which has two end portions that extend out of the hollow casing, upper and lower bearings for mounting rotatably and respectively the end portions of the drive shaft to top and bottom walls of the hollow casing so as to permit rotation of the drive shaft in two opposite revolving directions, and parallel first and second output shafts which are disposed transversely in the hollow casing and which have two end portions that extend out of the hollow casing and that are mounted rotatably to opposite side walls of the hollow casing. The massage drive unit further includes first and second gear sets, each of which has a drive gear disposed coaxially on the drive shaft, and a driven gear meshing with the drive gear and connected rigidly to a respective one of the first and second output shafts. A tubular sleeve is provided around an intermediate portion of the drive shaft between the drive gears of the first and second gear sets. Fastening members are disposed on two ends of the tubular sleeve and retain the latter on the drive shaft. First and second one-way clutches are provided coaxially on the drive shaft between the drive shaft and the drive gear of a respective one of the first and second gear sets. The first and second one-way clutches are operable respectively to the opposite revolving directions and engage selectively the drive gear of one of the first and second gear sets with the drive shaft depending on the direction of rotation of the latter. A linkage unit is mounted pivotally to the end portions of the first and second output shafts on one end and has a massaging wheel unit mounted rotatably on the other end.

For the first gear set, the gear ratio of the drive gear to the driven gear is about 1:9, whereas for the second gear set, the gear ratio of the drive gear to the driven gear is about 1:1. Thus, the first output shaft, when driven by the first gear set, rotates at a slower speed as compared to the second output shaft when the latter is driven by the second gear set. As the massage drive unit travels up and down along the guiding unit, rotation of the first output shaft causes the massaging wheel unit to impart a kneading massaging action on the spine of a user seated on the chair, while rotation of the second output shaft causes the massaging wheel unit to impart a tapping massaging action on the spine of the user. The first and second one-way clutches minimize the mechanical noise that is generated as the drive shaft engages and disengages the first and second gear sets.

The main drawback of the known variable massage drive unit is as follows: The first and second one-way clutches serve to prevent the drive shaft from driving simultaneously the first and second output shafts. However, it is noted that when the massage drive unit is assembled, the drive gears of the first and second gear sets are clamped tightly between the tubular sleeve and a respective one of the upper and lower bearings. Since parts of the upper and lower bearings rotate with the drive shaft, friction between the upper and lower bearings and the drive gear of the corresponding one of the first and second gear sets will cause the latter to rotate and drive the associated driven gear and output shaft to rotate. In other words, although the first and second one-way clutches engage only one of the first and second gear sets with the drive shaft at one time, the drive shaft still drives rotatably, albeit indirectly, the other one of the first and second gear sets via the corresponding one of the upper and lower bearings. This results in improper operation of the massage drive unit.

SUMMARY OF THE INVENTION

Therefore, the object of the present invention is to provide a variable massage drive unit having one-way clutches for driving selectively alternate gear sets of the massage drive unit and which can effectively prevent simultaneous driving of the alternate gear sets to ensure proper operation of the massage drive unit.

Accordingly, the variable massage drive unit is adapted for use in a chair-type massage apparatus and includes a hollow casing, a rotatable drive shaft disposed uprightly in the hollow casing and having two end portions that extend out of the hollow casing, upper and lower bearings for mounting rotatably and respectively the end portions of the drive shaft to top and bottom walls of the hollow casing so as to permit rotation of the drive shaft in two opposite revolving directions, parallel first and second output shafts disposed transversely in the hollow casing and having two end portions that extend out of the hollow casing and that are mounted rotatably to opposite side walls of the hollow casing, first and second gear sets, each of which has a drive gear disposed coaxially on the drive shaft and a driven gear meshing with the drive gear and connected rigidly to a respective one of the first and second output shafts, and first and second one-way clutches provided coaxially on the drive shaft between the drive shaft and the drive gear of a respective one of the first and second gear sets. The first and second one-way clutches are operable respectively to the opposite revolving directions and engage selectively the drive gear of one of the first and second gear sets with the drive shaft depending on direction of rotation of the drive shaft. The first output shaft, when driven by the first gear set, rotates at a slower speed as compared to the second output shaft when the second output shaft is driven by the second gear set.

The drive shaft has an intermediate portion with a cross-section that is larger than that of the end portions thereof. The drive gears of the first and second gears sets are provided on a respective one of the end portions of the drive shaft between the intermediate portion of the drive shaft and an adjacent one of the upper and lower bearings. A first thrust bearing is disposed coaxially on the drive shaft between the intermediate portion of the drive shaft and the first one-way clutch. A second thrust bearing is disposed coaxially on the drive shaft between the first one-way clutch and the upper bearing.

Preferably, a fastening member is provided on the drive shaft adjacent the second one-way clutch to retain securely the second one-way clutch on the drive shaft between the intermediate portion and the fastening member such that the second one-way clutch is spaced from the lower bearing.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
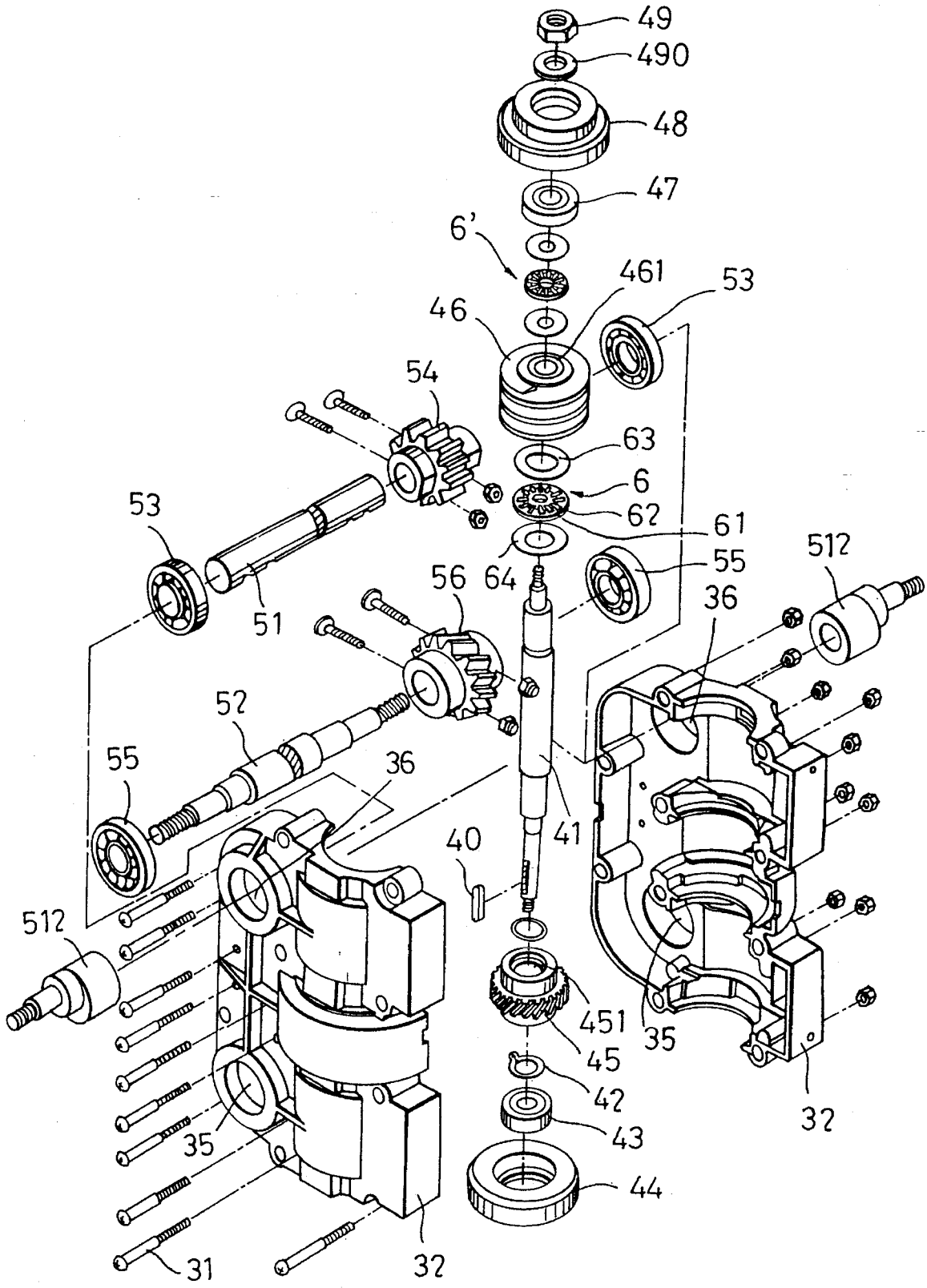
FIG. 1 illustrates an exploded view of the preferred embodiment of a variable massage drive unit according to the present invention.
Figure 2:
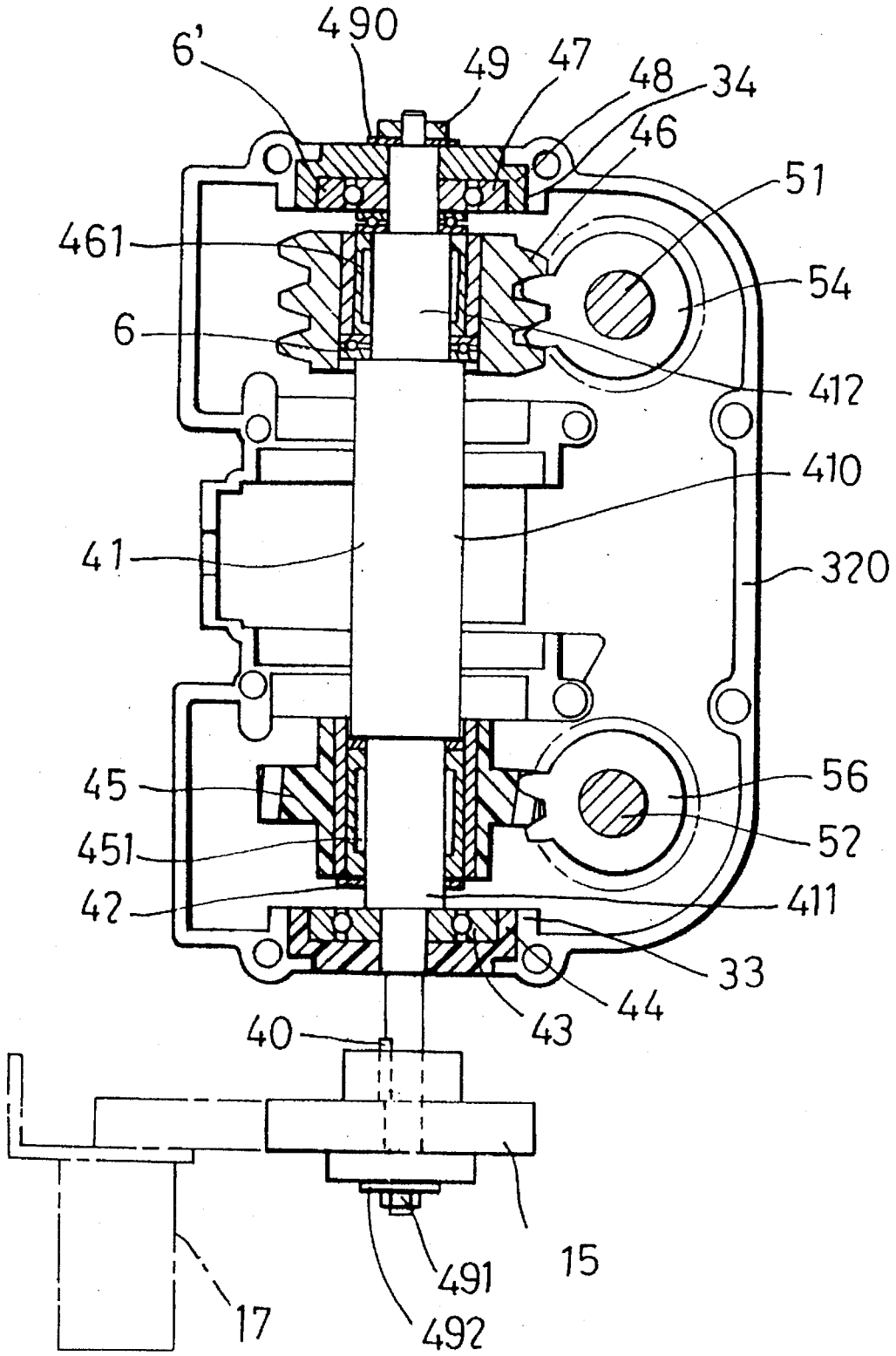
FIG. 2 is a sectional view of the preferred embodiment.

Referring to FIGS. 1 and 2, the preferred embodiment of a variable massage drive unit according to the present invention is shown to comprise a pair of casing halves 32 that are fastened together by a plurality of locking bolts 31 so as to form a hollow casing 320. The hollow casing 320 has top and bottom walls that are formed with aligned shaft holes 34, 33, and opposite side walls that are formed with two aligned pairs of shaft holes 35, 36. A rotatable drive shaft 41 is disposed uprightly in the hollow casing 320 and has two end portions 411, 412 that extend out of the hollow casing 320. A lower bearing 43 is secured on a lower cover 44 that is mounted in the shaft hole 33 of the hollow casing 320. The lower bearing 43 mounts rotatably the lower end portion 411 of the drive shaft 41 to the hollow casing 320. An upper bearing 47 is secured on an upper cover 48 that is mounted in the shaft hole 34 of the hollow casing 320. The upper bearing 47 mounts rotatably the upper end portion 412 of the drive shaft 41 to the hollow casing 320. The upper and lower bearings 47, 43 permit rotation of the drive shaft 41 in two opposite revolving directions. Parallel first and second output shafts 51, 52 are disposed transversely in the hollow casing 320 and have two end portions that extend out of the hollow casing 320 and that are mounted rotatably to the opposite side walls of the hollow casing, 320 via bearings 53, 55 disposed in the shaft holes 36, 35. In this embodiment, the first output shaft 51 have hubs 512 provided at the end portions thereof. The hubs 512 are radially eccentric relative to the axis of rotation of the first output shaft 51.

The variable massage drive unit further comprises first and second gear sets, each of which has a drive gear 46, 45 disposed coaxially on the drive shaft 41 and a driven gear 54, 56 meshing with the drive gear 46, 45 and connected rigidly to a respective one of the first and second output shafts 51, 52. In this embodiment, the drive shaft 41 has an intermediate portion 410 with a cross-section that is larger than that of the end portions 411,,412 thereof. The drive gears 46, 45 of the first and second gears sets are provided on a respective one of the end portions 412, 411 of the drive shaft 41 between the intermediate portion 410 and an adjacent one of the upper and lower bearings 47, 43. First and second one-way clutches 461, 451 are provided coaxially on the drive shaft 41 between the drive shaft 41 and the drive gear 46, 45 of a respective one of the first and second gear sets. The first and second one-way clutches 461, 451 are operable respectively to the opposite revolving directions of the drive shaft 41 and engage selectively the drive gear 46, 45 of one of the first and second gear sets with the drive shaft 41 depending on the direction of rotation of the latter. A washer 490 and a nut 49 are disposed above the upper cover 48 and engage a threaded tip of the upper end portion 412 of the drive shaft 41. The lower end portion 411 of the drive shaft 41 is formed with an axial key 40 and a threaded tip.

In order to prevent simultaneous driving of the first and second gear sets by the drive shaft 41, a first thrust bearing 6 is disposed coaxially on the drive shaft 41 between the intermediate portion 410 of the drive shaft 41 and the first one-way clutch 461. A second thrust bearing 6' is disposed coaxially on the drive shaft 41 between the first one-way clutch 461 and the upper bearing 47. A fastening member 42 is provided on the drive shaft 41 adjacent the second one-way clutch 451 to retain securely the latter on the drive shaft 41 between the intermediate portion 410 and the fastening member 42 such that the second one-way clutch 451 is spaced from the lower bearing 43.

Figure 3:
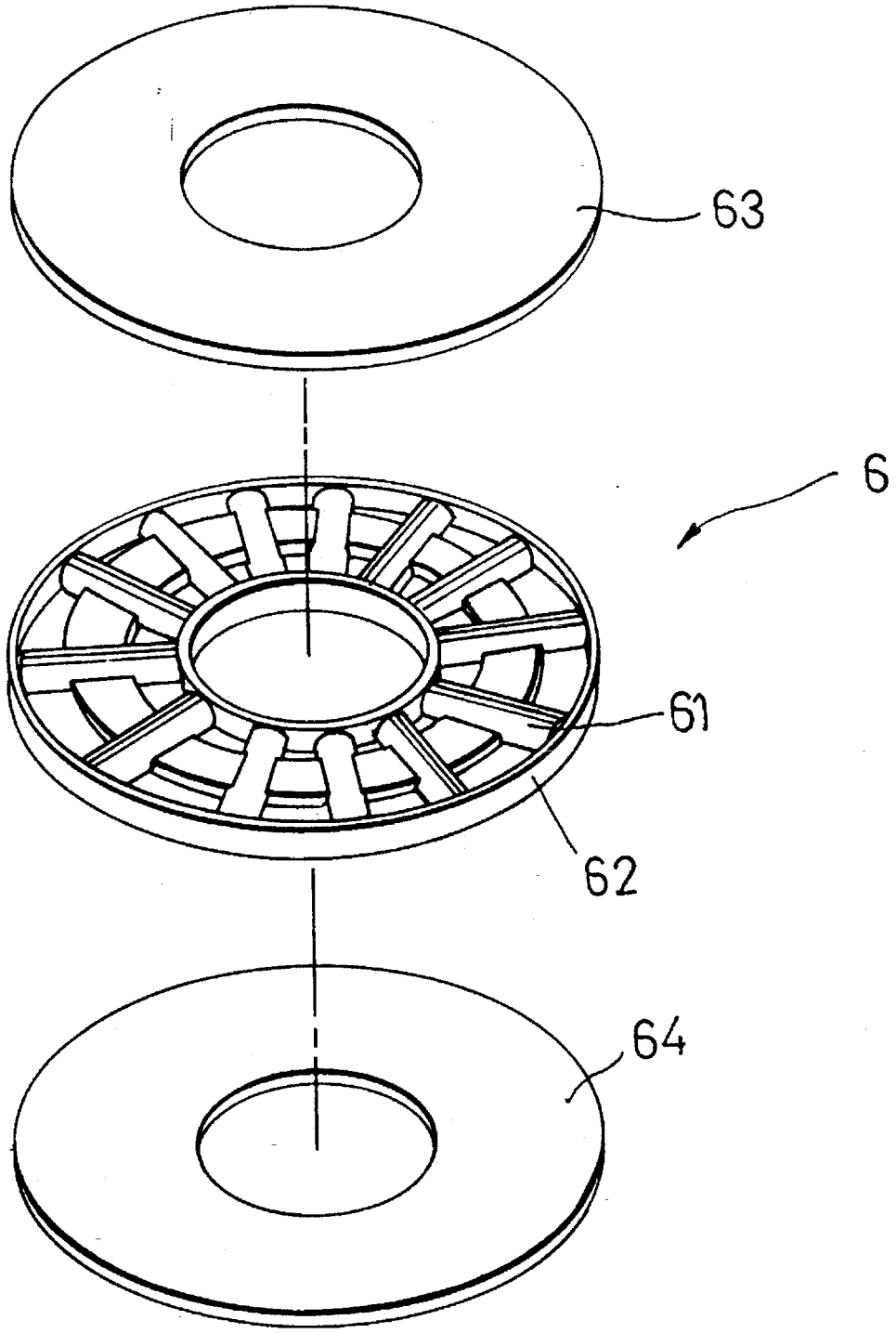
FIG. 3 is a partly exploded view of a thrust bearing employed in the preferred embodiment.

Referring to FIG. 3, the first thrust bearing 6 is shown to comprise upper and lower bearing plates 63, 64 and a race member 62 between the bearing plates 63, 64. A plurality of cylindrical rollers 61 are mounted rotatably and radially on the race member 62. The second thrust bearing 6' is similar to the first bearing member 6 in construction and will not be detailed further.

Figure 4:
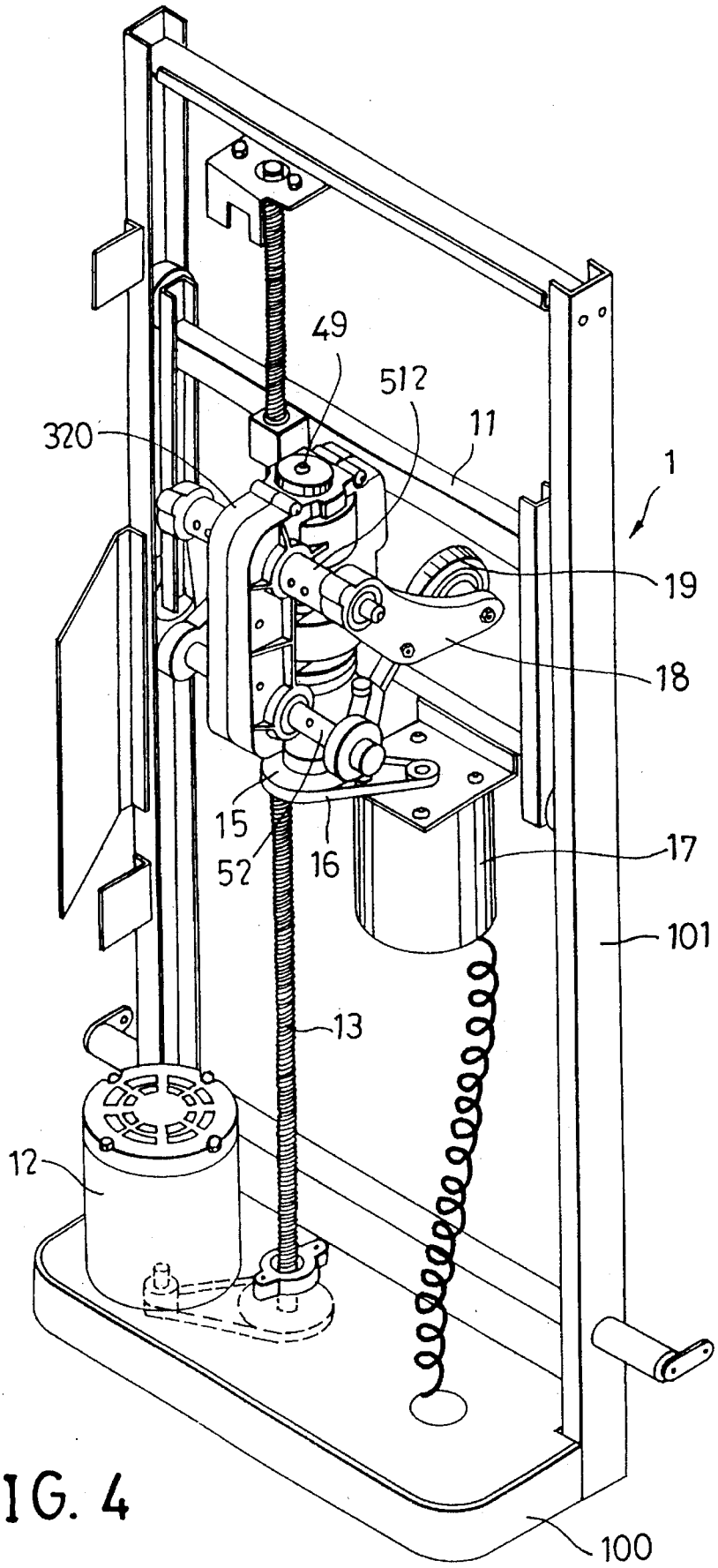
FIG. 4 is a perspective view of a chair-type massage apparatus which employs the massage drive unit of the present invention.

FIG. 4 illustrates a massage apparatus 1 which employs the massage drive unit of the present invention. The massage apparatus 1 is mountable on the backrest of a chair (not shown) and comprises a flat horizontal platform 100 and a vertically extending guide unit 101 mounted perpendicularly on the platform 100. A slide frame 11 is mounted slidably on the guide unit 101. A screw shaft 13 is mounted rotatably on the platform 100 and extends vertically therefrom. The slide frame 11 engages threadedly the screw shaft 13. A reversible motor 12 drives the screw shaft 13 to rotate in opposite directions, thereby causing up and down movement of the slide frame 11 along the guide unit 101. The hollow casing 320 of the massage drive unit is mounted on the slide frame 11. Referring once more to FIG. 2, a pulley 15 is mounted rotatably on the slide frame 11. The key 40 on the lower end portion 411 of the drive shaft 41 engages the pulley 15 to permit simultaneous rotation of the drive shaft 41 and the pulley 15. A washer 492 and a nut 491 engage the threaded tip of the lower end portion 411. Referring back to FIG. 4, a reversible motor 17 is mounted on the slide frame 11 and drives rotatably the pulley 15 via a belt 16. A linkage unit 18 is mounted pivotally to the hubs 512 on the end portions of the first output shaft 51 and on the end portions of the second output shaft 52 on one end, and has a massaging wheel unit 19 mounted rotatably on the other end.

For the first gear set, the gear ratio of the drive gear 46 to the driven gear 54 is preferably about 1:9, whereas for the second gear set, the gear ratio of the drive gear 45 to the driven gear 56 is preferably about 1:1. Thus, the first output shaft 51, when driven by the first gear set, rotates at a slower speed as compared to the second output shaft 52 when the latter is driven by the second gear set.

When the reversible motor 17 drives the drive shaft 41 to rotate in a first direction, the first one-way clutch 461 engages the first gear set with the drive shaft 41, thereby causing rotation of the first output shaft 51. Rotation of the first output shaft 51 causes the massaging wheel unit 19 to impart a kneading massaging action on the spine of a user seated on the chair. Accordingly, when the reversible motor 17 drives the drive shaft 41 to rotate in a second direction, the second one-way clutch 451 engages the second gear set with the drive shaft 41, thereby causing rotation of the second output shaft 52. Rotation of the second output shaft 52 causes the massaging wheel unit 19 to impart a tapping massaging action on the spine of the user.

The first and second thrust bearings 6, 6' are capable of sustaining axial forces and prevent axial movement of the first one-way clutch 461 and the drive gear 46 of the first gear set. Thus, when the second one-way clutch 451 engages the drive gear 45 of the second gear set with the drive shaft 41, the first and second thrust bearings 6, 6' can minimize friction between the first one-way clutch 461 and the upper bearing 47 and that between the first one-way clutch 461 and the intermediate portion 410 of the drive shaft 41, thereby preventing untimely driving of the drive gear 46 of the first gear set.

First and second thrust bearings 6, 6' may also be employed between the second one-way clutch 451 and the intermediate portion 410 of the drive shaft 41 and between the second one-way clutch 451 and the lower bearing 43 to prevent untimely driving of the drive gear 45 of the second gear set. However, since the drive gear 45 and the driven gear 56 rotate at about the same speed (gear ratio is 1:1), only a relatively small amount of axial forces is generated when the drive gear 45 drives rotatably the driven gear 56. Thus, the fastening member 42 is capable of sustaining such axial forces to retain the drive gear 45 spacedly from the lower bearing 43. Replacement of the second thrust bearing 6' with a fastening member is inadvisable since the latter would be unable to sustain the large amount of axial forces present when the drive gear 46 drives rotatably the driven gear 54 (gear ratio is 1:9).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A variable massage drive unit for a chair-type massage apparatus, said variable massage drive unit including a hollow casing, a rotatable drive shaft disposed uprightly in said hollow casing and having two end portions that extend out of said hollow casing, upper and lower bearings for mounting rotatably and respectively said end portions of said drive shaft to top and bottom walls of said hollow casing so as to permit rotation of said drive shaft in two opposite revolving directions, parallel first and second output shafts disposed transversely in said hollow casing and having two end portions that extend out of said hollow casing and that are mounted rotatably to opposite side walls of said hollow casing, first and second gear sets, each of which having a drive gear disposed coaxially on said drive shaft and a driven gear meshing with said drive gear and connected rigidly to a respective one of said first and second output shafts, first and second one-way clutches provided coaxially on said drive shaft between said drive shaft and said drive gear of a respective one of said first and second gear sets, said first and second one-way clutches being operable respectively to said opposite revolving directions and engaging selectively said drive gear of one of said first and second gear sets with said drive shaft depending on direction of rotation of said drive shaft, said first output shaft, when driven by said first gear set, rotating at a slower speed as compared to said second output shaft when said second output shaft is driven by said second gear set, wherein:

said drive shaft has an intermediate portion with a cross-section that is larger than that of said end portions thereof, each of said drive gears of said first and second gear sets being provided on a respective one of said end portions of said drive shaft between said intermediate portion of said drive shaft and an adjacent one of said upper and lower bearings; and said variable drive massage unit further includes a first thrust bearing disposed coaxially on said drive shaft between said intermediate portion of said drive shaft and said first one-way clutch, and a second thrust bearing disposed coaxially on said drive shaft between said first one-way clutch and said upper bearing.

2. The variable massage drive unit as claimed in claim 1, further including a fastening member provided on said drive shaft adjacent said second one-way clutch to retain securely said second one-way clutch on said drive shaft between said intermediate portion and said fastening member such that said second one-way clutch is spaced from said lower bearing.

* * * * *